US006516072B1

(12) United States Patent
Vinogradov et al.

(10) Patent No.: US 6,516,072 B1
(45) Date of Patent: Feb. 4, 2003

(54) LOUDSPEAKER

(76) Inventors: Alexei Vladimirovich Vinogradov, Dmitrovskoe hosse, d.89, korp 1, kv.91, Moscow 127486 (RU); Alexandr Sergeevich Gaidarov, pos Razvilka, d.25, kv. 143, Moskovskaya oblast 142717 (RU)

( * ) Notice: Subject to any disclaimer, the term of this patent is extended or adjusted under 35 U.S.C. 154(b) by 411 days.

(21) Appl. No.: 10/009,870

(22) PCT Filed: Jun. 9, 2000

(86) PCT No.: PCT/RU00/00225

§ 371 (c)(1),
(2), (4) Date: Dec. 10, 2001

(87) PCT Pub. No.: WO00/78092

PCT Pub. Date: Dec. 21, 2000

(30) Foreign Application Priority Data

Jun. 11, 1999 (RU) ..... 99112108

(51) Int. Cl.[7] ..... H04R 25/00

(52) U.S. Cl. ..... 381/160; 381/386; 381/182; 181/155

(58) Field of Search ..... 381/346, 347, 381/352, 160, 386, 387, 182, 186, 87, 89, 332; 181/155, 156, 144, 145, 147, 199

(56) References Cited

U.S. PATENT DOCUMENTS 5,173,942 A * 12/1992 Hirose ..... 381/160
5,446,792 A * 8/1995 Sango ..... 181/155
5,995,634 A * 11/1999 Zwolski ..... 381/160

* cited by examiner

*Primary Examiner*—Huyen Le
(74) *Attorney, Agent, or Firm*—Weiner & Burt, P.C.; Irving M. Weiner; Pamela S. Hurt

(57) ABSTRACT

A module of loudspeaker 1 for high-quality reproduction of music and voice has a direct radiating base electrodynamic driver (EDD) 2 transforming an electric signal to acoustic one at least in the middle-frequency part of the acoustic frequency range and an enclosure cabinet 3 of this driver 2, the cone 5 of which overlaps the mounting hole in the outside surface of this cabinet. The device is provided with an axial-symmetric acoustic reflector 4 faced the radiating aperture of base EDD 2 and placed outside the enclosure cabinet 5 coaxially with axis 6 of base EDD 2 wherein $$0{,}5\ R_E<\Delta<0{,}25\ \lambda_{max},\ \text{and}\ S_R=(1/3\div4)S_E,$$

where $R_E$—radius of the effective area of the radiating surface of base EDD 2;

$\Delta$—distance from the radiating aperture of base EDD 2 to the acoustic reflector 4;

$\lambda_{max}$—maximal acoustic wavelength in air, which is reproduced by base EDD 2;

$S_R$—area of acoustic reflector 4;

$S_E$—effective area of the radiating surface of base EDD 2.

The device may have a direct radiating low-frequency EDD with the corresponding acoustic reflector of the low-frequency radiation and also high-frequency electrodynamic drivers.

23 Claims, 4 Drawing Sheets

LOUDSPEAKER

The present invention relates to the field of electroacoustics and may be used in loud-speaker constructions for high-quality reproduction of music and voice in domestic conditions as well as in public-culture and professional audio reproduction systems, specifically in sound control channels, station announcement systems, transport means cabins and other places where an improved articulation is required, particularly in conditions of noise pollution and interferences.

PRIOR ART

Loudspeakers having a direct radiating electrodynamic driver (EDD) installed at the outer surface of the driver enclosure cabinet are well known and most widely used (see V. K. Iofe and others, HandBook of Acoustics, Moscow, "Svyaz", 1979).

Disadvantages of said devices, namely insufficient details and articulation of sound re-production, abrupt relationship between sound volume and distance R to EDD (by inverse-square law $1/R^2$), are associated to considerable dominance of a reactive (vector) component of their radiation over a necessary active (scalar) component.

These disadvantages are successfully overcome in a counteraperture loudspeaker comprising a module having a pair of identical, coaxial and inphase-counterradiating electrodynamic drivers transforming an electric signal into acoustic one at least in the middle-frequency part of the acoustic frequency range (see the International Application WO 95/05057, IPC$^6$ H04R5/02, 1995).

In said counteraperture loudspeaker, the active components of the counterdirected radiation of the identical electrodynamic driver pairs are added together while the vector components are mutually subtracted and thereby compensated.

Disadvantages of such devices are requirement of paired number of the electrodynamic drivers having identical characteristics in the pairs and enlarged loudspeaker dimensions due to the interaperture space volume.

Essence of the Invention

The main object of the present invention is to provide such loudspeaker construction which, on the one hand, would ensure high-quality sound reproduction by reducing the reactive component of the loudspeaker radiation and the parametric distortions (Doppler effect), associated to said component, and on the other hand, would not require use of pairs of identical band electrodynamic drivers, at the expense of that could be more compact and more simple to manufacture and adjust thereby would have relatively low manufacturing cost.

The basis for the present invention is the principle of operation of a counteraperture loudspeaker as well as the physico-mathematical idea of that the symmetry plane of given counteraperture loudspeaker, which is perpendicular to the common axis of the radiating apertures, is a plane of mirror symmetry. Symmetry is herein taken to mean not only a constructive symmetry, but also symmetry of dynamic of physical processes taking place at operation of the loudspeaker. Therefore, if any reflector overlapping the area of interaction of the vector, or velocity streams radiated by the electrodynamic drivers of the counteraperture pairs is placed in said plane, neither physical phenomena nor a degree of their development during the loudspeaker operation will not vary. Thus, a counteraperture loudspeaker having a reflector located in the above-mentioned plane may be formally represented as a pair of coaxial, counterdisposed, independent semicounteraperture loudspeakers, each of which is an independent module, all radiation aspects of which have full complex of unique positive properties of the counteraperture loudspeaker and which is more compact and less materials-intensive by comparison to the counteraperture loudspeaker.

The main object of the present invention is reached by that in a loudspeaker comprising a module having a direct radiating base electrodynamic driver (EDD) to transform an electrical signal into acoustic one at least in the middle-frequency part of the acoustic frequency range and an enclosure cabinet of said base EDD having a cone overlapping the mounting hole in the outside surface of said cabinet, according to the invention, the module is provided with an axial-symmetric acoustic reflector faced the radiating aperture of said base EDD and placed outside said enclosure cabinet and coaxially with said base EDD, wherein the distance $\Delta$ from the radiating aperture of the base EDD to the acoustic reflector is no less than half the radius $R_E$ of the effective area of the radiating surface of the base EDD but no more than a quarter of the maximal acoustic wavelength $\lambda_{max}$ in air, which is reproduced by the base EDD while the area $S_R$ of the acoustic reflector is no less than one third of and no more than the quadruple effective area $S_E$ of the radiating surface of the base EDD, that is:

$$0{,}5R_E \leqq \Delta \leqq 0{,}25\lambda_{max}, \quad (1)$$

$$S_R = (1/3 \div 4)S_E. \quad (2)$$

To get the most uniformity of the acoustic field in a comfort insonification zone, specifically in a comfort insonification plane (that is in the plane where presence of listener heads is supposed), the claimed loudspeaker is disposed in a room so that the base EDD axis would be normal to the plane of comfort insonification while this plane would intersect said axis between the base EDD and its acoustic reflector. So, if a room subject to insonification has a horizontal floor (for example, a dancing hall or a fashion demonstration hall), the axis of the base EDD is located vertically while the height of the loudspeaker placing corresponds to the position of listeners heads. When a room floor is slanted, the axis of the base EDD of the loudspeaker module is located perpendicularly to the plane of the floor room envelope. If a room subject to insonification has a ceiling, the base EDD is essentially faced upward while the acoustic reflector is placed above the base EDD. When the insonification is being performed in an unclosed space, the base EDD is faced downwards (to a floor) while the acoustic reflector is placed under the base EDD.

Further, according to the invention, the loudspeaker module may be provided with at least one high-frequency EDD (hereinafter HF EDD) which may be installed coaxially to the base EDD. The coaxial HF EDD and base EDD may be placed both unidirectionally and counterdirectionally. When the HF EDD and base EDD are placed counterdirectionally, the distance $\Delta_H$ between their radiating apertures is no less than radius $R_{EH}$ of the effective area of the HF EDD radiating surface but no more than the distance $\Delta$ from the radiating aperture of the base EDD to the acoustic reflector, that is:

$$R_{EH} \leqq \Delta_H \leqq \Delta. \quad (3)$$

One of the HF EDD may be installed coaxially and unidirectionally with the base EDD behind the backside of the acoustic reflector.

The above-mentioned placing the HF EDD (coaxially with the base EDD) assists in providing the most uniformity (non-directivity) of the resulting loudspeaker radiation.

If it is necessary to provide radiation directivity, the axis at least one of the HF EDD, according to the invention, is normal to the axis of the base EDD.

Further, the module of the claimed loudspeaker may be provided with a direct radiating low-frequency EDD (hereinafter LF EDD), a cone of which overlaps the mounting hole in the outside surface of an enclosure cabinet of the LF EDD, and also with an axial-symmetric low-frequency radiation acoustic reflector (hereinafter LF acoustic reflector), faced the radiating aperture of the LF EDD and placed outside the enclosure cabinet of the LF EDD and coaxially with the base EDD and LF EDD. Thus the LF EDD is placed co-axially with the base EDD. At that the distance $\Delta_L$ from the radiating aperture of the LF EDD to the LF acoustic reflector is no less than half the radius $R_{EL}$ of the effective area of the radiating surface of the LF EDD but no more than a quarter of the maximal acoustic wavelength $\lambda_{L\ max}$ in air, which is reproduced by the LF EDD while the area $S_{RL}$ of the LF acoustic reflector is no less than one third of and no more than the quadruple effective area $S_{EL}$ of the radiating surface of the LF EDD, that is:

$$0{,}5R_{EL} \leqq \Delta_L \leqq 0{,}25\lambda_{L\ max}, \tag{4}$$

$$S_{RL} = (1/3 \div 4)S_{EL}. \tag{5}$$

Herein, the effective area of the radiating surface of any EDD should be understood as an area of a round flat piston, the end surface of which has a volume oscillating velocity equal to the EDD volume oscillating velocity that, in turn, is equal to a surface integral of the oscillating velocity of elementary parts of the EDD cone:

$$\int^{S} \vec{V} dS_E, \tag{6}$$

where $\vec{V}$—the volume oscillating velocity of an elementary part of the EDD cone;

$dS_E$—the area of the elementary part of the cone.

Besides it should be clear that the area of one or other acoustic reflector is understood as the area of its working surface that is the surface faced the radiating aperture of the EDD corresponding to the given acoustic reflector, and only such surface is understood as the "acoustic reflector surface" in the present specification.

Limits of the distances $\Delta$ and $\Delta_L$ are selected so as to provide a mode of the loudspeaker operation within limits of action of the travelling wave mechanism for flexural excitation waves radially extending in the cone.

Each EDD cone simultaneously acts in two ways: it serves as a radial transmission line of the axial excitation from a voice coil to all the peripheral cone surface parts, moreover the excited cone parts being moved act upon neighbour air molecules, involving them in motion. To ensure effective operation of the cone as said radial transmission line of the excitation signal, a concordance of this line is required, just as for any other transmission line, that is reflections (in this case, reflections of the flexural waves) from inevitable discontinuities should be reduced, excluded, or compensated. The distances $\Delta H \Delta_L$ are selected such that, in the corresponding pair "cone-acoustic reflector", a reflected dynamic pressure excited by the central near-coil (in the case of a taper cone) part of the cone would come to the peripheral cone part in antiphase to the radial flexural wave propagated over the cone in this time and would quenched this wave at the cone edge thereby excluding standing waves in the cone and a multiplicity of a transformer response to specific temporary excitation.

The loudspeaker cone is a medium rigider than air but not perfectly rigid, therefore the distances $\Delta$ and $\Delta_L$ should be no less than half the radius of the corresponding cone (it is a condition of phase opposition of the reflected signal for a perfectly rigid cone moving as a single whole) but no more than a quarter of the corresponding wavelength $\Delta_L$ max and $\Delta_{L\ max}$ for the most non-rigid cone, the speed of flexural excitation wave propagation in which is equal to acoustic speed in air.

The area of one or other acoustic reflector, according to the invention, is selected within the limits determining the effective use of a co-oscillating undistorted part of the excited air for the reflection that would ensure, on the one hand, an approximate equality of the antiphase vector excitation products, and on the other hand, the described above quenching the flexural oscillations reflected from the discontinuities in the cone corresponding to given EDD acoustic reflector. Therefore the least area $S_R$ or $S_{RL}$ amounts to ⅓ from $S_E$ and $S_{EL}$ correspondingly (such as for a cones having large viscosity loss), and the most one should not exceed the area $S_E$ and $S_{EL}$ correspondingly more than four times because, if the acoustic reflector area is more, a radial-circular transmission line appears outside the effective radius of the cone. Such line acts as a Fabri-Perot resonator with all corresponding undesirable consequences. Thus, specific values of the parameters $\Delta$, $\Delta_L$, $S_{RH}S_{RL}$ depend on material of the cone, its configuration, thickness, density, rigidity, viscosity, and, therefore, is determined for a specific EDD.

According to the invention, LF acoustic reflector may be fixed at the backside of the enclosure cabinet of the base EDD. Particularly, the surface of said back side may be used as the LF acoustic reflector.

The surface of one or other acoustic reflector may be have flat or curved shape including convex, concave or stepped shape.

To provide a constancy of acoustic wave propagation in air and over the cone in the claimed loudspeaker, the envelope of surface parts of one or other acoustic reflector may be similar to the envelope of surface parts of the cone corresponding to given acoustic reflector wherein the scale coefficient of said similarity is in the range from minus two to plus two. The "minus" sign implies that the curvature of the acoustic reflector is the inverse of the cone curvature.

For the purposes of determination of the distances $\Delta_H \Delta_L$, it is considered that the radiating aperture of the corresponding EDD is placed in a plane of fastening of the EDD cone peripheral part with the enclosure cabinet of this EDD. Here, if the surface of any acoustic reflector is non-planar, said distances $\Delta_h \Delta_L$ are measured to an equivalent plane of the acoustic reflector. So, the distance from the radiating aperture of any EDD to the acoustic reflector corresponding to this EDD is substantially the distance from the plane of the EDD cone peripheral part fastening with the EDD enclosure cabinet to the equivalent plane of the acoustic reflector. A disclosure of the term "equivalent plane" of the acoustic reflector will be given below using the drawings of FIG. 4 and 5.

If necessary, at least a part of the area of one or both of the acoustic reflectors may be perforated to decrease the Q-factor of the oscillations.

One or both of the acoustic reflector may be attached to the enclosure cabinet of the corresponding EDD by one or more ribs placed radially concerning the axis of the base EDD.

If the acoustic reflector is attached to the enclosure cabinet of the corresponding EDD by two or more said ribs, these ribs may be fastened with each other by flat or cone-shaped rings forming, together with said ribs, horn cells of a radial acoustic lens to additionally accent or correct a sound directional diagram in the vertical plane. Here the inner diameters of these rings are selected such that the rings would not overlap even in part a cross-section of an imaginary taper having a linear generatrix passing through the peripheral edges of the acoustic reflector and the cone of the corresponding EDD. This condition is required to provide an unimpeded passing the sound streaming waves from the EDD to the corresponding acoustic reflector.

Said ribs and fastening rings are mainly placed symmetrically relating to the axis of the base EDD. However, if the uniform sound propagation in all the radial directions from the base EDD axis, in other words, the radial uniformity (non-directivity) of the radiation is not required, the above-mentioned symmetrical placing of said ribs and rings is not obligatory.

When the cone of the base EDD and/or LF EDD is a cone without a dust cap, the corresponding acoustic acoustic reflector may be attached to a magnetic system core of the corresponding EDD by a central rod.

In order to increase the insonification area and/or dynamic range of sound reproduction (sound amplification), the claimed loudspeaker may be composed of even number of said modules which are placed in pairs and made according to one of the above-mentioned embodiments described in the claims attached. The base electrodynamic drivers in each module pair are placed coaxially. Here, the module pair may include both identical and different modules, the base electrodynamic drivers of which may be placed both unidirectionally and counterdirectionally.

If the base electrodynamic drivers in a module pair are faced towards each other, the distance between their acoustic reflectors is selected such that the acoustic reflector and the enclosure cabinet of one of said base electrodynamic drivers of the pair would not extend outside a cross-section of an imaginary taper having a linear generatrix passing through the peripheral edges of other acoustic reflector and the corresponding cone of other EDD. Said condition of selection of the distance between the acoustic reflectors should be met to avoid an ingress of the radiating reflected from the acoustic reflector as well as from the enclosure cabinet of one EDD of the pair to the cone of other EDD of this pair.

In the case, when a module pair is composed of identical modules, the base electrodynamic drivers of which are faced towards each other, the distance between their acoustic reflectors may be zero, then one common acoustic reflector having a two-sided work surface may be used for both base electrodynamic drivers of the pair.

If a directed radiation non-symmetrical in the vertical plane is required (when insonifying sports ground, swimming pools, big halls, stations and the like), the base electrodynamic drivers in the module pair are placed unidirectionally, wherein the distance between the acoustic reflector of the first base EDD located ahead in the direction of radiation of the base electrodynamic drivers in the pair and the enclosure cabinet of the second base EDD in the pair is selected such that the acoustic reflector and the enclosure cabinet of the second base EDD would not extend outside a cross-section of an imaginary taper having a linear generatrix passing through the peripheral edges of the acoustic reflector and the cone of the first base EDD.

The aforesaid condition of the lack of reflections from the acoustic reflector or enclosure cabinet of any given EDD to any other EDD should be met in any multimodule embodiment of the claimed loudspeaker. At the same time, in order to avoid unjustified increase of the loudspeaker overall dimensions, the distance between any acoustic reflector of one of loudspeaker modules and a structural component of other module, which said component is able to operate as a reflector, is selected as less as possible, when the mentioned acoustic reflector still overlaps the cross-section of interaction with its cone and therefore obstructs any other structural components able to affect the reflections.

Further the invention is explained by some specific embodiments of the claimed loudspeaker with reference to the drawings listed below.

EMBODIMENTS OF THE INVENTION

Figure 1:
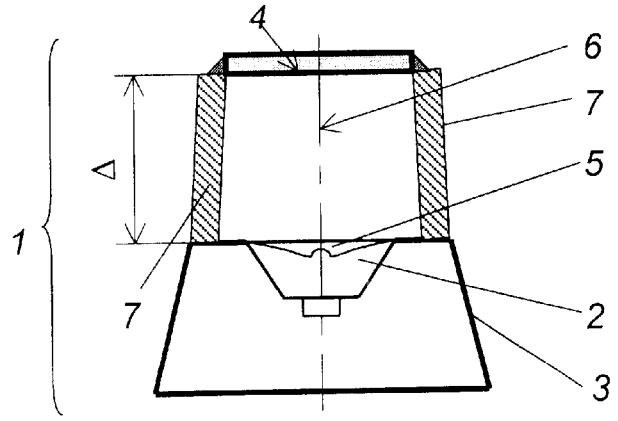
FIG. 1 is a view of the claimed loudspeaker module having only one, base EDD.
Figure 6:
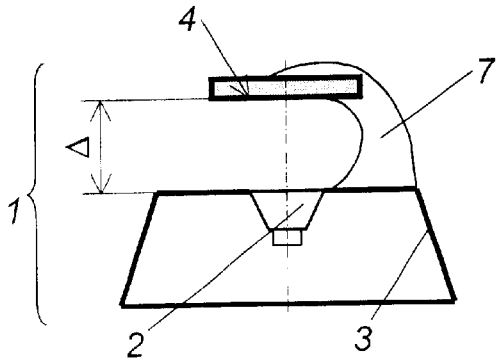
FIG. 6 is a view of an embodiment of the acoustic reflector attachment by one rib.

In one of the most simple embodiments, a module of the claimed loudspeaker 1 (FIG. 1) has a direct radiating base EDD 2 (it should be distinguished from a horn EDD) transforming electrical signals into acoustic ones at least in the middle-frequency part of the acoustic frequency range, an enclosure cabinet 3 of EDD 2 and also an acoustic reflector 4 of the direct radiation of EDD 2. The last is placed in the cabinet 3 so that its cone 5 overlaps the mounting hole in the outside surface of this cabinet 3. Acoustic reflector 4 is faced to the radiating aperture (to cone 5) of EDD 2, has a shape symmetric relative to the axis 6 of EDD 2 (axial-symmetric shape) and is fixed in position outside cabinet 3, coaxially with EDD 2 at a distance Δ from the radiating aperture of EDD 2. Said distance lies within the range defined by the relation (1) while area $S_R$ of acoustic reflector 4 is selected within the limits defined by the relation (2). Cabinet 3 may be made as an closed type box or phase-inverting type box and also as a box having an acoustic resistance panel or a box with a transmittion line etc. Acoustic reflector 4 is attached to cabinet 3 by several ribs 7 placing radially concerning axis 6 or by one such rib (FIG. 6). Ribs 7 are connected with acoustic reflector 4 and cabinet 3 by any appropriate known method (by welding, soldering, riveting etc.).

Figure 2:
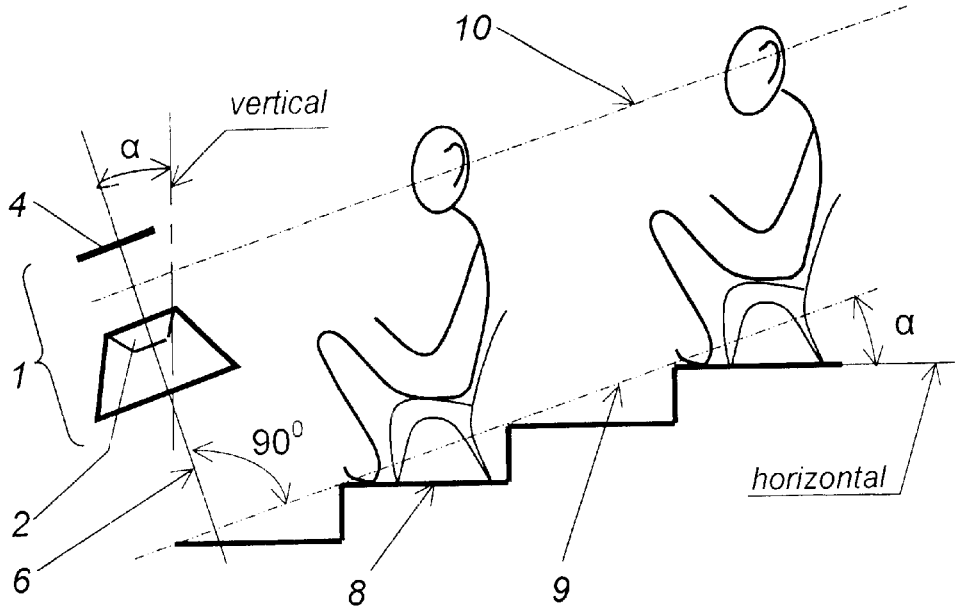
FIG. 2 is a diagram of location of the claimed loudspeaker module when insonifying a room having a slanted (stepped) floor.

FIG. 2 illustrates placing the claimed loudspeaker module in a room having a stepped floor 8. Axis 6 of base EDD 2 of loudspeaker 1 (this axis is also the axis of acoustic reflector 4 and thus substantially represents the axis of the module of loudspeaker 1 as a whole) is deflected from the vertical by angle a that is the inclination of plane 9 of the envelope of floor 8 to place this axis normally to a plane 10 of comfortable insonification wherein plane 10 should transverse loudspeaker 1 preferably between its EDD 2 and acoustic reflector 4.

Figure 3:
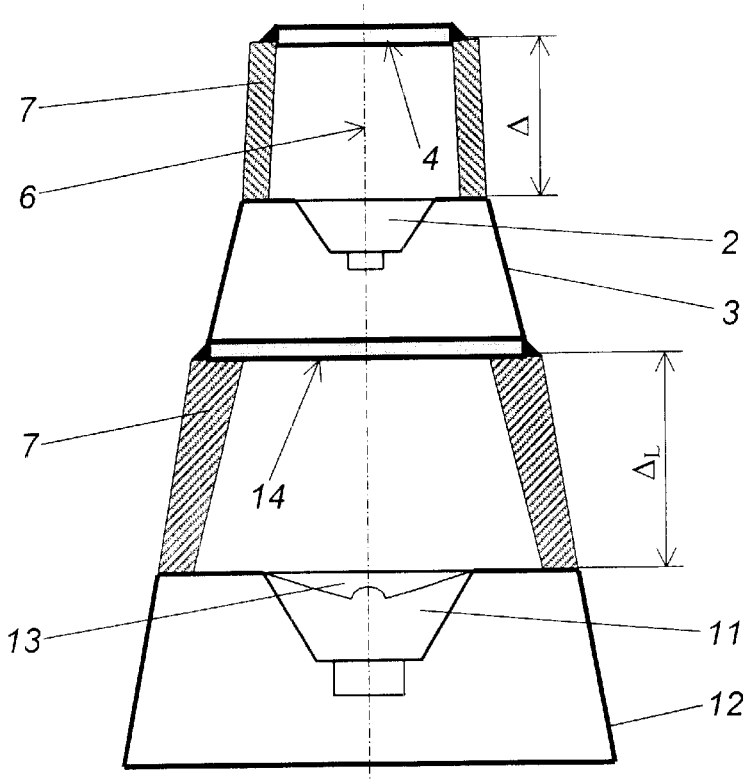
FIG. 3 is a view of an embodiment of the loudspeaker module provided with LF EDD.

FIG. 3 shows a claimed loudspeaker module provided with, besides base EDD 2, a direct radiating LF EDD 11 having its corresponding enclosure cabinet 12. A cone 13 of LF EDD 11 overlaps the corresponding mounting hole in the outside surface of cabinet 12. LF EDD 11 is placed coaxially with base EDD 2. An axial-symmetric acoustic reflector 14 (hereinafter LF acoustic reflector) of the low-frequency radiation running from LF EDD 11 is fixed in position outside cabinet 12. Distance $\Delta_L$ from the radiating aperture of LF EDD 11 to acoustic reflector 14 is selected from the above relation (4) by analogy with selection of distance $\Delta$ while area $S_{RL}$ of LF acoustic reflector 14 is selected by the relation (5) similarly to selection of area $S_R$ of acoustic reflector 4 of base EDD 2. It is shown from FIG. 3 that LF acoustic reflector 14 may be fastened at the back side of enclosure cabinet 3 of base EDD 2 or the surface of this side of cabinet 3 can act itself as LF acoustic reflector 14.

Figure 4:
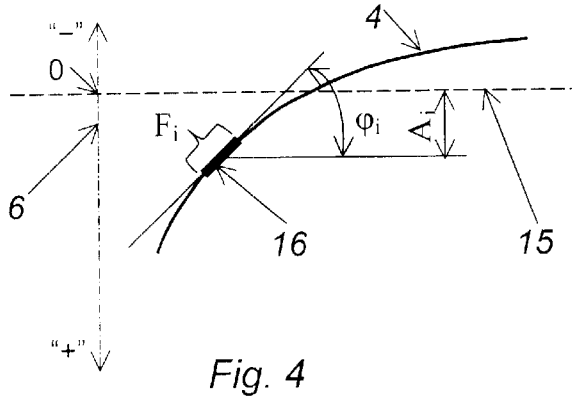
FIG. 4 is a diagram explaining the term "equivalent plane" of the acoustic reflector for the general case, when its surface is non-planar.

For the purposes of determination of the distances ($\Delta_H\Delta_L$) from the radiating aperture of base EDD or LF EDD to the corresponding acoustic reflector where the shape of the acoustic reflector surface is non-planar (such as a taper or stepped shape), the term "equivalent plane" of the acoustic reflector should be used. In the general case (see FIG. 4), the equivalent plane 15 of acoustic reflector 4 or 14 is imaginary plane which is normal to axis 6 while the integral of product of projection of an elementary part 16 of acoustic reflector 4 or 14 to a plane normal to axis 6 and the distance being measured along axis 6 from this elementary part 16 to equivalent plane 15 over the acoustic reflector area is equal zero that is:

$$\int^{F} A_i \cdot \cos\varphi_i \cdot dF_i = 0, \tag{7}$$

where $A_i$—distance being measured along axis 6 (taking into account plus and minus signs) from an elementary i-th part of the acoustic reflector to the equivalent plane of this acoustic reflector;

$\phi_i$—angle of inclination of said i-th elementary part to a plane which is normal to the axis of the base EDD;

$dF_i$—area of said i-th elementary part.

If the acoustic reflector surface is stepped while the step planes are normal to axis 6 (see FIG. 5), then for this special case, the integral relation (7) is simplified by rearrangement into sum of products of areas $F_n$ of a stepped n-th parts of the acoustic reflector surface and distances $A_n$ being measured along axis 6 (taking into account plus and minus signs) from said n-th stepped parts to equivalent plane 15:

$$\sum_{n=1}^{m} F_n \cdot A_n = 0, \tag{8}$$

where m—number of said stepped parts, n—integer from 1 to m.

Figure 5:
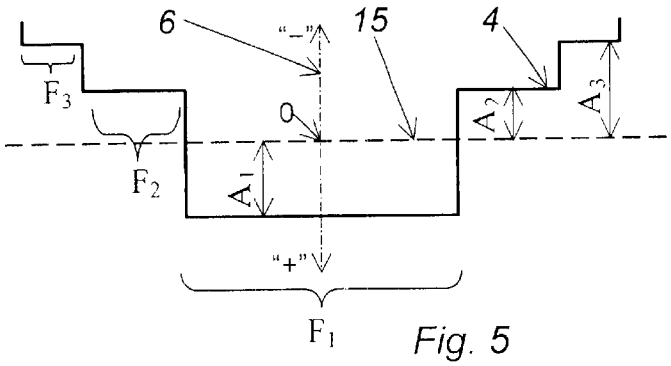
FIG. 5 is the same for the special case, when acoustic reflector's surface is stepped.

The surface of acoustic reflector 4 or 14 shown on FIG. 5 has three stepped parts: the first round part having area $F_1$ and two circular parts having areas $F_2$ and $F_3$ where location of equivalent plane 15 meets the following condition:

$$F_i{\cdot}A_1+F_2{\cdot}A_2+F_3A_3=0 \tag{9}$$

When viewing along axis 6 of base EDD 2, acoustic reflector 4 or 14 may have different axis-symmetric form, particularly, a circular form, a rounded form such as ellipse, or a polygonal, star-shaped and many-petaled form.

The cross-section of ribs 7 used to attach acoustic reflector 4 or 14 to cabinet 3 or 12 correspondingly may have a rectangular form and also a tapered, tear-shaped or rhombic form. If the rib cross-section thickness is non-constant along the radial direction, then more narrow part of this cross-section is directed towards the base EDD axis that corresponds to the sound propagation in the radial direction from the base EDD axis and, in this case, ensures the absence of harmful reflections of acoustic waves from the rib surface faced the base EDD axis.

When acoustic reflector 4 (or 14) is attached to cabinet 3 (or 12 correspondingly) with several ribs 7 placed around axis 6, then these ribs are fastened with each other by means of flat or cone-shaped rings 17 (see FIG. 7) which, together with ribs 7, form cells of a radial acoustic lens. Rings 17 should not overlap, even in part, a cross-section of an imaginary taper, the axis of which is aligned with axis 6, and the linear generatrix 18 of which passes through the peripheral edges of acoustic reflector 4 (or 14) and cone 5 (or 13 correspondingly) therefore the inner diameter of rings 17 is selected from this condition.

Figure 7:
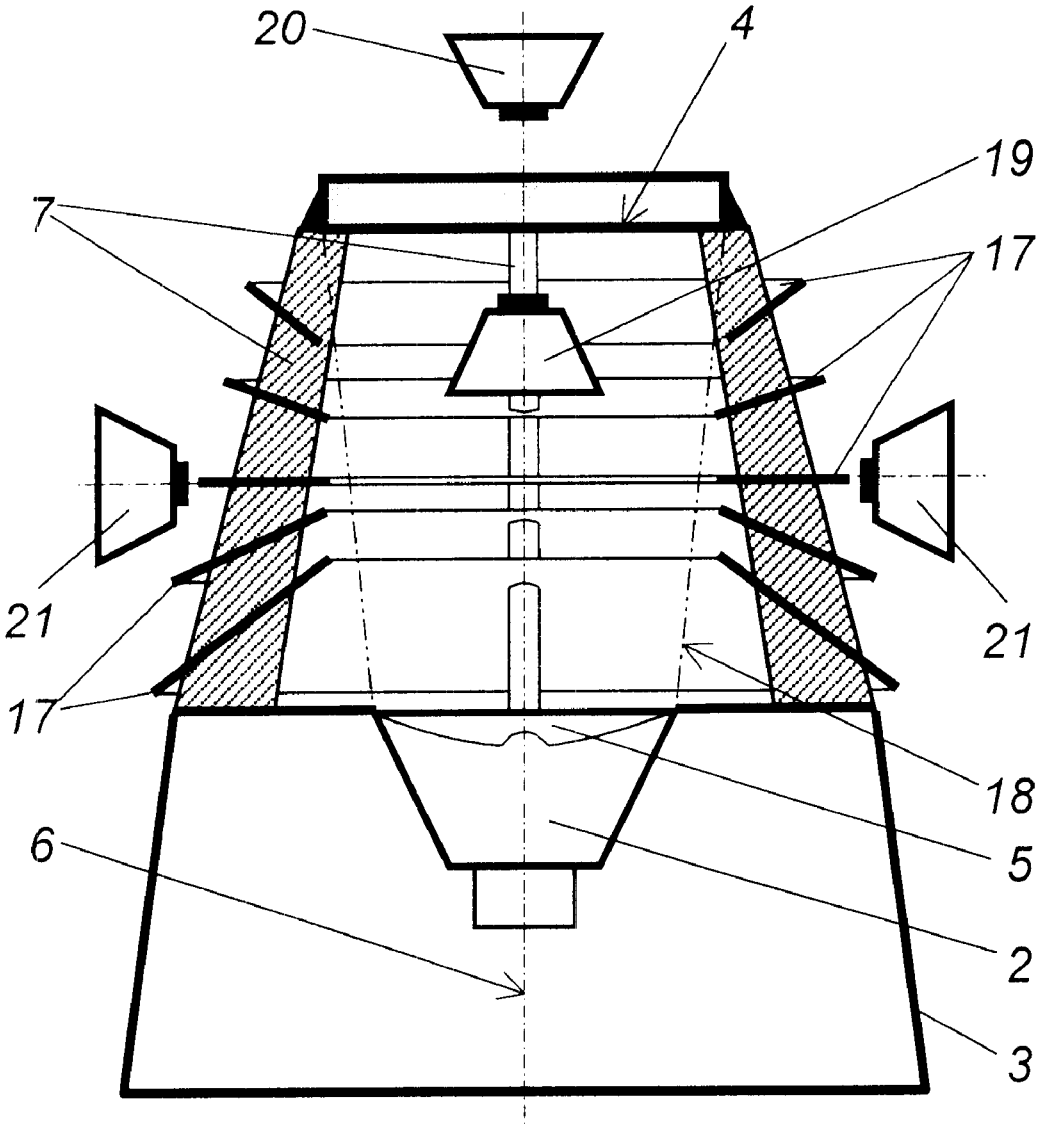
FIG. 7 is a view of an embodiment where several ribs are fastened with each other by the rings, and the loudspeaker is provided with the first, second and additional high-frequency electrodynamic drivers.

In FIG. 7 is shown an embodiment of the loudspeaker having, according the invention, besides base EDD 2, the first HF EDD 19, the second HF EDD 20 and additional HF EDD 21. The first and second HF EDD 19, 20 are placed coaxially with base EDD 2 with the first HF EDD 19 is installed between base EDD 2 and acoustic reflector 4 and faced towards base EDD 2 while the second HF EDD 20 is installed behind the back side of acoustic reflector 4 unidirectionally with base EDD 2. Additional HF EDD 21 are placed around axis 6 of base EDD 2 between the location planes of the radiating apertures of base EDD 2 and second HF EDD 20. The axes of additional HF EDD 21 are normal to axis 6. HF EDD 19–21 may be both of a direct radiating type and a horn type. Combinations of non-identical HF EDD of different types in the same loudspeaker are possible.

Figure 8:
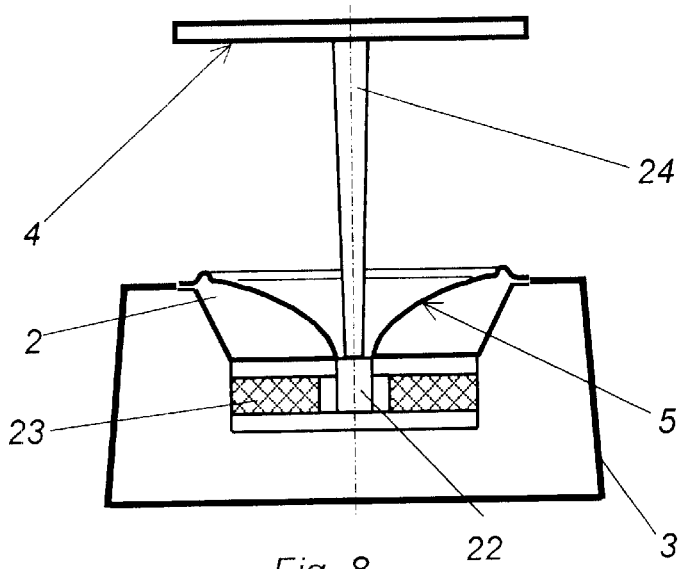
FIG. 8 is a view of an embodiment of the acoustic reflector attachment by a central rod.

In FIG. 8 is shown an embodiment of the claimed loudspeaker where cone 5 (or 13) of base EDD 2 (or LF EDD 11 correspondingly) is a cone without a dust cap. In this case, acoustic reflector 4 (or 14) is attached to a core 22 of the magnetic system 23 of base EDD 2 (or LF EDD 11 correspondingly) by a cylindrical or conical central rod 24. In order to decrease the material-intensity of the device, rod 24 may be hollow, and to ensure a sufficient rigidity it may be ribbed.

Figure 9:
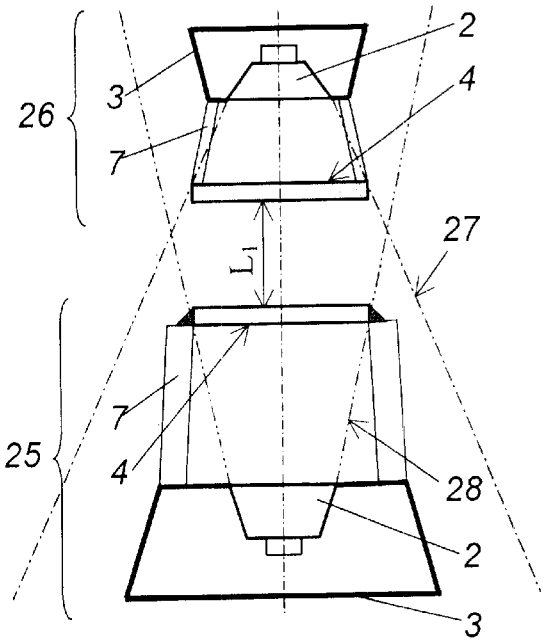
FIG. 9 is a view of an embodiment where the claimed loudspeaker is composed of two coaxial modules, the base EDD of which are faced towards each other.

In FIG. 9 is shown a loudspeaker composed, according to the invention, of two non-identical modules, namely of a lower module 25 and an upper module 26, base EDD 2 of which are placed counterdirectionally and coaxially. The distance $L_1$ between acoustic reflectors 4 of these modules is selected such that the acoustic reflector and the enclosure cabinet of the base EDD of lower module 25 would not extend outside any cross-section of an imaginary taper having a linear generatrix 27 passing through the peripheral edges of the acoustic reflector and cone of base EDD of the upper module 26, and vise versa, that the acoustic reflector and the enclosure cabinet of the base EDD of upper module 26 would not extend outside any cross-section of an imaginary taper, the linear generatrix 28 of which passes through the peripheral edges of the acoustic reflector and cone of the base EDD of lower module 25.

Figure 10:
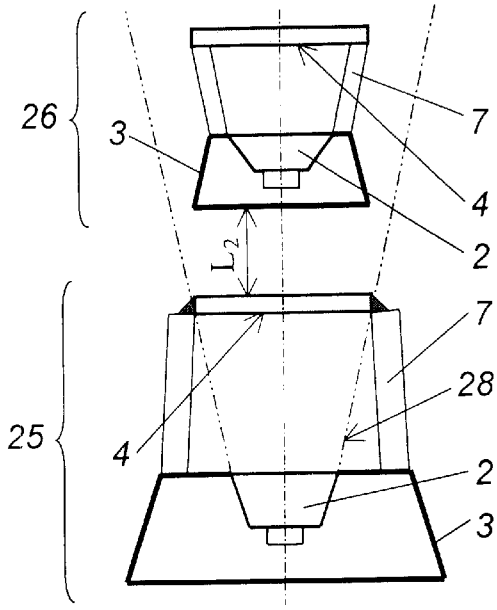
FIG. 10 is a view of an embodiment where the claimed loudspeaker is composed of two coaxial modules, the base EDD of which are placed unidirectionally.

FIG. 10 illustrates an embodiment of modular construction of the claimed loudspeaker where base EDD 2 of modules 25, 26 are placed coaxially and unidirectionally while module 25 is located ahead in the direction of radiation of base EDD 2, and module 26 is located behind. In this case, the distance $L_2$ from the base EDD acoustic reflector of the first module 25 to the base EDD enclosure cabinet of the second module 26 is selected such that the acoustic reflector and the base EDD enclosure cabinet of second module 25 would not extend outside any cross-section of an imaginary taper having a linear generatrix 28 passing through the peripheral edges of the acoustic reflector and cone of the base EDD of first module 25.

Industrial Applicability

Principle of the claimed loudspeaker operation lies in the following. A signal voltage arising at the amplifier output causes a current in a voice coil of EDD. The magnetic field of this current interacts with the constant radial field of the EDD magnetic system and thus forms an axial force setting the EDD cone in motion. This motion occurs due to ring flexural waves propagating over the cone. At the same time, an acceleration of the cone parts causes a compressive and tensile partial air deformation directly forming necessary acoustic pressure (a scalar product) while the cone oscillation speed causes an axial co-oscillation of non-deformable air layers near the cone (a vector product). EDD effectively transforms a signal only on those frequencies on which the length of an acoustic wave in air is more than the cone diameter. In this frequency range, the reactive (vector) radiation resistance component exceeds the active (scalar) component many times. Therefore a basis of the radiation is the reactive component, useless in itself, for which the law of conservation of momentum ($m\vec{V}$) in a space angle of radiation is true but not the energy conservation law ($mV^2/2$), consequently the acoustic pressure caused mainly by the volumetric oscillating speed decreases under the law $1/R^2$ (here R—the distance from a radiator to receiver). Besides in such system, even if it is absolutely linear, parametric distortions appear in the form of Doppler frequency intermodulation as a result of the radiating surface motion along the radiator-listener direction.

The presence of the coaxial acoustic reflector of the base EDD and LF EDD in the loudspeaker construction allows to obtain a counterdirected, almost equal in magnitude, velocity pressure thus compensating the vector radiation component and its associated parametric distortions. Moreover, said opposite velocity pressure transforms the direct and reflected speeds to a local concentration change of the air molecules, that is to the active radiation component thus changing the relation between the active and reactive components of the medium radiation resistance to the exciter in favour of the active component.

The area and shape of the acoustic reflector and also distance between the acoustic reflector and the specific EDD for its specific enclosure cabinet are selected on condition that a traveling-wave mode for the ring flexural waves radially propagating in the cone will be ensured since the cone not only affects the air but also serves as the excitation transmission line from the voice coil to all its own surface parts affecting the air. Anyone of discontinuities in this radial transmission line causes the reflections of the flexural waves. The reflected waves interfere with the direct ones, creating standing waves which excite the air medium too. It results both in a disruption of the temporal coherence of the signals being transformed and in a frequency discrimination that is the amplitude-frequency response non-linearity. The acoustic reflector use permits to additionally affect the main discontinuities of the cone, namely its coupling with the peripheral collar and the cone holder, much as optic antireflecting coatings act: when two equal in magnitude reflected signals superpose on one other in opposite phase, they annihilate each other. The same approach simultaneously solves a task of a self-coordination of the distributed in time and space interaction of the cone surface parts with atmosphere.

Thus, the acoustic reflector use in the claimed loudspeaker in which the above-considered parameters $\Delta$, $\Delta_L$, $S_R$ and $S_{RL}$, are correctly selected permits integrally to settle the main matters of the efficiency and quality of the audio reproduction.

The claimed invention use permits to enhance the audio reproduction quality due to the loudspeaker construction change, the complexity and cost of which are minor. Consumers of any price or pretension levels have possibility to reproduce a sound of the High-End quality when not only an information content is enhanced, but a naturalness, lively performance atmosphere, reproduction of the finest details of a masterly execution and conductor's individuality, before unachievable clearness and articulation (intelligibility) of the audio reproduction are ensured. At the same time, product cost resulting from material, labour and energy inputs remains practically constant and is typical for usual quantity production of Hi-Fi category.

The scope of the present invention is not limited by the above-mentioned embodiments. Other specific embodiments of the loudspeakers are possible within the bound of the claims attached.

What is claimed is:

1. A loudspeaker comprising a module having a direct radiating base electrodynamic driver to transform an electrical signal into acoustic one at least in the middle-frequency part of the acoustic frequency range and an enclosure cabinet of said base electrodynamic driver having a cone overlapping the mounting hole in the outside surface of said cabinet, characterized by that the module is provided with an axial-symmetric acoustic reflector faced the radiating aperture of said base electrodynamic driver and placed outside said enclosure cabinet and coaxially with said base electrodynamic driver, wherein $$0{,}5\ R_E \leqq \Delta \leqq 0{,}25\ \lambda_{max}, \text{ and}$$

$$S_R = (1/3 \div 4) S_E,$$

where $R_E$—radius of the effective area of the radiating surface of the base electrodynamic driver;

$\Delta$—distance from the radiating aperture of the base electrodynamic driver to the acoustic reflector;

$\lambda_{max}$—maximal acoustic wavelength in air, which is reproduced by the base electrodynamic driver;

$S_R$—area of the acoustic reflector;

$S_E$—effective area of the radiating surface of the base electrodynamic driver.

2. The loudspeaker as defined in claim 1, characterized by that the general axis of the base electrodynamic driver and acoustic reflector is substantially normal to a comfort insonification plane.

3. The loudspeaker as defined in claim 1, characterized by that the module is provided with at least one high-frequency electrodynamic driver.

4. The loudspeaker as defined in claim 3, characterized by that at least one high-frequency electrodynamic driver is coaxial with the base electrodynamic driver.

5. The loudspeaker as defined in claim 4, characterized by that the coaxial base and high-frequency electrodynamic drivers are counterdirected with the distance between their radiating apertures is no less than radius of the effective area of the radiating surface of the high-frequency electrodynamic driver but no more than the distance from the radiating aperture of the base electrodynamic driver to the acoustic reflector.

6. The loudspeaker as defined in claim 3, characterized by that one of the high-frequency electrodynamic drivers is installed behind the back side of the acoustic reflector, coaxially and unidirectionally with the base electrodynamic driver.

7. The loudspeaker as defined in claim 3, characterized by that the axis of the at least one high-frequency electrodynamic driver is normal to the axis of the base electrodynamic driver.

8. The loudspeaker as defined in claim 1, characterized by that the module is provided with a direct radiating low-frequency electrodynamic driver placed coaxially with the base one, an enclosure cabinet of said low-frequency electrodynamic driver having a cone over-lapping the mounting hole in the outside surface of said enclosure cabinet of the low-frequency electrodynamic driver, an axial-symmetric low-frequency radiation acoustic reflector faced the radiating aperture of said low-frequency electrodynamic driver and placed outside the enclosure cabinet of the low-frequency electrodynamic driver and coaxially with it, wherein $$0{,}5\ R_{EL} \leqq \Delta_L \leqq 0{,}25\ \lambda_{L\ max}, \text{ and}$$

$$S_{RL} = (1/3 \div 4) S_{EL},$$

where $R_{EL}$—radius of the effective area of the radiating surface of the low-frequency electrodynamic driver;

$\Delta_L$—distance from the radiating aperture of the low-frequency electrodynamic driver to the low-frequency radiation acoustic reflector;

$\lambda_{L\ max}$—maximal acoustic wavelength in air, which is reproduced by the low-frequency electrodynamic driver;

$S_{RL}$—the area of the low-frequency radiation acoustic reflector;

$S_{EL}$—the effective area of the radiating surface of the low-frequency electrodynamic driver.

9. The loudspeaker as defined in claim 8, characterized by that the low-frequency radiation acoustic reflector is fixed at the back side of the enclosure cabinet of the base electrodynamic driver.

10. The loudspeaker as defined in claim 9, characterized by that the back surface of the enclosure cabinet of the base electrodynamic driver is used as the low-frequency radiation acoustic reflector.

11. The loudspeaker as defined in claim 8, characterized by that the envelope of surface parts of the low-frequency radiation acoustic reflector is similar to the envelope of surface parts of the low-frequency electrodynamic driver cone wherein the scale coefficient of said similarity is in the range from minus two to plus two.

12. The loudspeaker as defined in claim 8, characterized by that at least a part of the area of the low-frequency radiation acoustic reflector is perforated.

13. The loudspeaker as defined in claim 8, characterized by that the low-frequency radiation acoustic reflector is attached to the enclosure cabinet of the low-frequency electrodynamic driver by at least one rib placed radially concerning the axis of the base electrodynamic driver.

14. The loudspeaker as defined in claim 13, characterized by that the low-frequency radiation acoustic reflector is attached to the enclosure cabinet of the low-frequency electrodynamic driver by at least two said ribs fastened with each other by flat or cone-shaped rings forming, together with said ribs, cells of a radial acoustic lens wherein the inner diameters of the rings are selected such that rings would not overlap, even in part, a cross-section of an imaginary taper having a linear generatrix passing through the peripheral edges of the low-frequency radiation acoustic reflector and the cone of the low-frequency electrodynamic driver.

15. The loudspeaker as defined in claim 8, characterized by that the cone of the low-frequency electrodynamic driver is a cone without a dust cap, and the low-frequency radiation acoustic reflector is attached to a magnetic system core of the low-frequency electrodynamic driver by a central rod.

16. The loudspeaker as defined in claim 1, characterized by that the envelope of surface parts of the acoustic reflector of the base electrodynamic driver is similar to the envelope of surface parts of the base electrodynamic driver cone wherein the scale coefficient of said similarity is in the range from minus two to plus two.

17. The loudspeaker as defined in claim 1, characterized by that at least a part of the area of the acoustic reflector of the base electrodynamic driver is perforated.

18. The loudspeaker as defined in claim 1, characterized by that the acoustic reflector of the base electrodynamic driver is attached to the enclosure cabinet of the base electrodynamic driver by at least one rib placed radially concerning the axis of the base electrodynamic driver.

19. The loudspeaker as defined in claim 18, characterized by that the acoustic reflector of the base electrodynamic driver is attached to the enclosure cabinet of the base electrodynamic driver by at least two said ribs fastened with each other by flat or cone-shaped rings forming, together with said ribs, cells of a radial acoustic lens wherein the inner diameters of the rings are selected such that rings would not overlap, even in part, a cross-section of an imaginary taper having a linear generatrix passing through the peripheral edges of the acoustic reflector and the cone of the base electrodynamic driver.

20. The loudspeaker as defined in claim 1, characterized by that the cone of the base electrodynamic driver is a cone without a dust cap, and the acoustic reflector of the base electrodynamic driver is attached to a magnetic system core of the base electrodynamic driver by a central rod.

21. The loudspeaker as defined in claim 1, characterized by that it is composed of even number of said modules placed in pairs with the base electrodynamic drivers in each pair are placed coaxially.

22. The loudspeaker as defined in claim 21, characterized by that the base electrodynamic drivers in a pair of the modules are faced towards each other and the distance between the acoustic reflectors of these electrodynamic drivers is selected such that the acoustic reflector and the enclosure cabinet of one of said base electrodynamic drivers of the pair would not extend outside a cross-section of an imaginary taper having a linear generatrix passing through the peripheral edges of other acoustic reflector and the corresponding cone of other base electrodynamic driver in this pair.

23. The loudspeaker as defined in claim 21, characterized by that the base electrodynamic drivers in a pair of the modules are placed unidirectionally and the distance between the acoustic reflector of the first base electrodynamic driver located ahead in the direction of radiation of the base electrodynamic drivers in the pair and the enclosure cabinet of the second base electrodynamic driver in the pair is selected such that the acoustic reflector and enclosure cabinet of the second base electrodynamic driver would not extend outside a cross-section of an imaginary taper having a linear generatrix passing through the peripheral edges of the acoustic reflector and cone of the first base electrodynamic driver.

* * * * *